235-382 SR
4/12/88 XR 4,737,785

United States Patent [19]

Zottnik

[11] Patent Number: 4,737,785

[45] Date of Patent: Apr. 12, 1988

[54] DEVICE FOR LOCKS

[75] Inventor: Edmund Zottnik, Gerlingen, Fed. Rep. of Germany

[73] Assignee: Hans J. Hertneck, Renningen-Malmsheim, Fed. Rep. of Germany

[21] Appl. No.: 667,110

[22] PCT Filed: Mar. 8, 1984

[86] PCT No.: PCT/DE84/00045

§ 371 Date: Nov. 1, 1984

§ 102(e) Date: Nov. 1, 1984

[87] PCT Pub. No.: WO84/03533

PCT Pub. Date: Sep. 13, 1984

[30] Foreign Application Priority Data

Mar. 8, 1983 [ES] Spain ..... 520422

[51] Int. Cl.[4] ..... H04Q 1/00; E05B 47/00

[52] U.S. Cl. ..... 340/825.31; 235/382; 361/172; 70/276

[58] Field of Search ..... 340/825.3, 825.31, 825.32; 235/449, 382; 70/276, 288; 361/172

[56] References Cited

U.S. PATENT DOCUMENTS

| | | | |
|---|---|---|---|
| 3,042,887 | 7/1962 | Kuhrt | 338/32 H |
| 3,680,026 | 7/1972 | Masuda et al. | 338/32 H |
| 3,848,252 | 11/1974 | Chang et al. | 338/32 H |
| 3,961,160 | 6/1976 | Gorgens | 340/825.3 |
| 4,197,987 | 4/1980 | Lazzari | 235/449 |
| 4,354,189 | 10/1982 | Lemelson | 340/825.31 |
| 4,439,671 | 3/1984 | Helle | 235/449 |
| 4,523,243 | 6/1985 | Billington | 235/449 |

FOREIGN PATENT DOCUMENTS

| | | |
|---|---|---|
| 2948619 | 6/1981 | Fed. Rep. of Germany . |
| 2296182 | 7/1976 | France . |
| 2511421 | 2/1983 | France . |
| 8102603 | 9/1981 | PCT Int'l Appl. . |
| 8103335 | 11/1981 | PCT Int'l Appl. . |
| 2080390 | 2/1982 | United Kingdom . |

*Primary Examiner*—Donald J. Yusko
*Attorney, Agent, or Firm*—McAulay, Fields, Fisher, Goldstein & Nissen

[57] ABSTRACT

Safety mechanism for locks (electronic lock) comprising a pick-up performing the function of a key and a sensor performing the function of a lock part. The pick-up is provided with a pre-determined surface arrangement of magnetically permeable, preferably inactive material in the form of soft-iron pins forming exciting elements, which forms a code. For detecting the code of the pick-up, the sensor is provided with an arrangement of sensor elements in a surface matrix of the same geometrical extension, which sensor elements can be varied as to their ohmic resistance by a change in the distribution of the magnetic field lines and take the form of magnetically controllable magneto-resistors. The magneto-resistors are set up, preferably, in the manner of an integrated circuit. The magneto-resistors are followed by comparators which are suitably wired to store the code word in an unerasable manner and which in the presence of a correct pick-up code assume an output potential driving an evaluator circuit connected to its output to release a locking mechanism.

11 Claims, 3 Drawing Sheets

DEVICE FOR LOCKS

BACKGROUND OF THE INVENTION

The present invention proceeds from a device for locks and other locking mechanisms, safety mechanisms and the like, for permitting authorized access to buildings, rooms, motor vehicles and the like, in accordance with the preamble of the main claim.

Safety mechanisms capable of distinguishing between authorized and unauthorized access to buildings, motor vehicles and the like, of preventing the removal of objects and/or of activating or deactivating alarm systems, either simultaneously or otherwise, have been known in many different forms, from usual bit locks, in particular in the form of cylinder locks, to the so-called electronic locks which operate through the entry and evaluation of pre-determined codes.

The known systems discussed hereafter, in particular as regards the electronic arrangement of locks, cover, therefore, only a selection from the given spectrum.

In order to cause the locking mechanism of the known key lock to be released during an access check, or the like, one has to enter a multi-digit number, whereupon the locking mechanism is released provided the correct number has been entered in the correct order. However, this system provides the risk that accompanying persons may observe the entry and memorize the number so entered. Another problem connected with this system resides in the circumstance that a person may forget such a multi-digit number or enter it incorrectly, in particular when acting under stress, which may provide the disadvantage that, apart from the locking mechanism not being released, even a subsequent entry of the correct number may under certain circumstances be blocked for a pre-determined period of time if the system is equipped to prevent trying out of the correct number. But it has anyway been general usage to note the key number of the key lock in some written form so that the code is always physically available. Finally, such a keyboard must have a certain minimum size and be sufficiently protected against environmental influences which makes a key lock of this type suitable mainly for use in enclosed rooms.

The known magnetic card locks are operated by means of a card comprising a carrier on which data have been magnetically recorded and which is introduced into a reading device. The information contained on the carrier strip is read out and the lock is released when conformity is established between such information and a stored code information.

A certain drawback connected with such magnetic card locks is to be seen, however, in the relatively high expense connected with the reading device, which normally must be provided with an electro-mechanical drive, and the facility with which the information can be erased. For, to erase the information contained on the card, it suffices already to bring or store the card near a strong electromagnetic field. The necessary field strengths are, for example, reached already by loudspeakers or mains transformers of radio receivers. Further, a problem may reside in the fact that it may be impossible to protect the access to the reading device for the card against environmental influences which means that such cards are also mainly suited for use in enclosed rooms and that the magnetic information can be easily changed and, accordingly, copied with the same ease.

Magnetic card locks of the type just described are closely related to locks using inductively readable cards. Their operation is similar to that of magnetic card locks—the code carrier is provided in the middle of the card with a continuous metal film whose surface is subdivided into quadrants. By moving these films past inductive reading heads, the quadrants comprising a hole can be distinguished from those having none. This binary information represents the code which is compared with a firmly stored code. The main disadvantage of this inductively readable card is to be seen in the fact that here again an electromagnetic drive is required which offers certain disadvantages regarding the sensitivity to environmental influences and the operating safety. An advantage of the inductively readable card could be seen in the fact that the information present in a digital form can be processed by computers or microprocessors.

Finally, it is also possible to provide a so-called electronic contact lock, in which both the key and the lock are provided with identical resistance networks, with a predetermined number of junctions that can be tapped. By establishing suitable contacts, certain junctions may be selected and related to the contacts of the key so as to provide a code. The contact to the key is implemented as sensor contact because the contact strip required for scanning the key is to carry potential only during the active phase. When the key is placed on a contact strip, the lock is activated by a sensor strip and the coding of the two networks is compared. In case of conformity over a pre-determined period of time, the lock is released. The main drawback of such an electronic contact lock is to be seen in the required contacts and the relatively complex key which is difficult to produce. Contact irregularities which can never be excluded may also require repeated actuations, and in the long run it is also unavoidable that the contact strip gets contaminated and errors are introduced.

Finally, it is also known to provide a coding on a card in the form of opaque and/or transparent sectors forming data or clock tracks which can be detected by the reading device on infrared basis and compared with the stored correct code. If reading is to be effected without motor-driven insertion, then special measures have to be taken to prevent misinterpretations of the code when the card is inserted arbitrarily.

SUMMARY OF THE INVENTION

Now, it is the object of the present invention to provide an electronic lock in which the transfer of the code by magnetic action can take place in extremely limited space, yet with high safety, and without the risk of the respective code becoming accessible to any unauthorized persons.

ADVANTAGES OF THE INVENTION

The present invention achieves this object by the characterizing features of the main claim and, using sensor elements arranged in highest packing density in the manner of a surface matrix and capable of being influenced exclusively as regards their ohmic resistance value, by selective magnetic action, it offers the advantage of being absolutely independent of environmental influences and of requiring no mechanically moved parts which means that it does not include any wearing mechanical drive.

On the other hand, the device of the invention uses binary data so that it is also compatible for evaluation by means of process computers, microprocessors, and the like.

Picking up of the code is contactless—by suitably bundling magnetic field lines in the area of the sensor element, the latter are influenced only as regards their resistance value so that specific evaluable switching positions—magneto-resistors of a chip set up in integrated circuit technology—can be detected at the sensor elements by a change in switching position of operational amplifiers or comparators which are connected to the output ends of such sensor elements, but which are dynamically driven. To say it in other words: the connection of the magneto-resistors forming variable ohmic resistances to the inputs of the operational amplifiers is realized via capacitors.

It is another advantage of the invention that the pick-up, which performs the function of a key in the present invention, is provided with a coding that cannot be detected at all, or only with an extremely high input of work and expenses, and that operation of the lock or locking mechanism through the sensor can be effected absolutely unconcealed, it being only necessary to make the pick-up coincide with the sensor surface. The dimensions of the complementary surfaces of the pick-up and sensor forming surface matrixes may be so small that the pick-up can be accommodated easily for example in the surface of a signet ring or the like in which case the lock can be operated without any problems by inserting the signet ring into, or pressing it against, a matching recess in the sensor area of the lock. The coding of the key (pick-up) is in this case absolutely unknown, and in effect of no interest, to the user. The key may even be lent to other persons because it is practically impossible to copy it.

The operating safety of the safety mechanism according to the invention is absolute because no active elements or systems whatever—but only soft-magnetic elements, partial areas or pins, provided preferably in a specific surface matrix distribution—are provided in the area of the key or pick-up and because the sensor is secured against aging, external influences or other interference by a suitable electronic wiring scheme.

The resistances, which are arranged preferably in the form of a surface matrix and which may be provided on the sensor in practically any desired number and distribution, are applied preferably by the usual etching method or other processes used in the production of integrated and/or highly integrated circuits, for example by suitable doping of silicon substrates with antimony or other impurities so that such "resistors" which may also be referred to as magneto-resistors, will vary their resistance value in response to the variation of the magnetic field lines passing them. The variation of the ohmic resistance value of the resistors, which are interconnected in a desired manner in the form of a matrix, is then achieved in that a specific magnetic bias is generated in the area of the magneto-resistors of the surface matrix by the arrangement of a permanent magnet, which bias is selectively varied by elements, for example soft-magnetic elements introduced from the pick-up into the area of specific ones of the said magneto-resistors or resistances, which leads to a concentration of magnetic field lines in the respective areas. The sensor elements, magneto-resistors or magnetically controlled resistances, as the surface matrix of the sensor may also be called, react, or may react, to this concentration of the magnetic field lines in their area in such a manner that the conducting paths of the magnet-oresistors are constricted in the direction of current flow under an increased action of the magnetic field strength which will also result in a variation of the ohmic resistance value of the magneto-resistors.

The sensor therefore consists of a system of resistors arranged on a surface (surface matrix) the resistance value of which can be controlled by magnetic action, the dimensions of both the individual sensor elements and the whole sensor surface intended for interaction with the pick-up surface being extremely small. The user only has to place the associated complementary pick-up surface on the sensor surface comprising the magnetically controlled resistors.

The outer appearance of the sensor and the complementary pick-up may be selected at desire and may, for example, have the flat geometrical form of an ellipse, a rectangle, a polygon, or the like.

The features described in the sub-claims provide advantageous improvements and developments of the safety mechanism provided by the main claim. A particular advantageous arrangement is provided if the operational amplifiers or comparators connected to the outputs of the individual magneto-resistors are all commonly biased by a single voltage divider connected to their two inputs so that they are safely biased and assume a defined condition. As a result, the offset voltage remains the same for all operational amplifiers. The voltage jump resulting from the resistance variation occurring when the system is activated by the pick-up is then additionally coupled in on one of the inputs of each operational amplifier via a capacitor. The time constant for this process is preferably selected to be approx. 1 second so that on the one hand there is sufficient time to prevent already at this point any possible detection of the code by mere trying, while on the other hand it is ensured that the interruption of the d.c. coupling provoked by the capacitor will have been safely canceled at the end of this time constant.

BRIEF DESCRIPTION OF THE DRAWINGS

Certain embodiments of the invention will be described hereafter in detail with reference to the drawing in which.

DETAILED DESCRIPTION OF THE INVENTION

Figure 1:
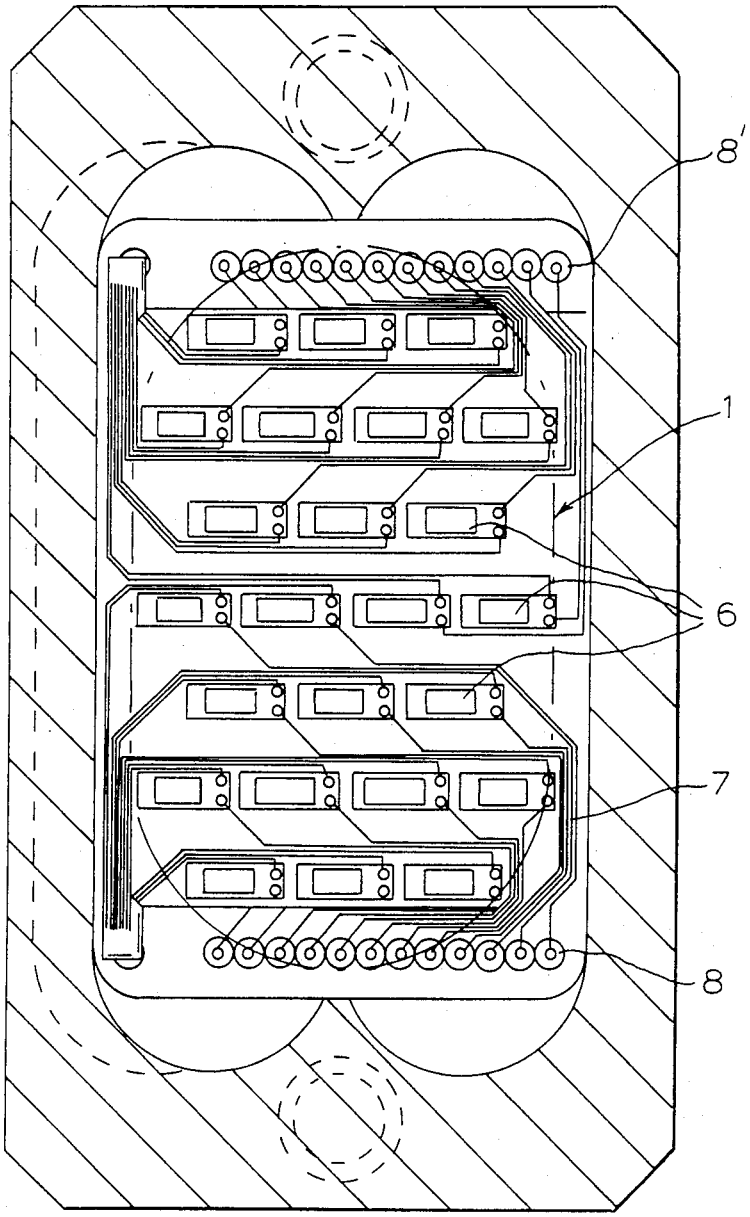
FIG. 1 shows a sectional top view of the sensor in which the surface distribution of the magnetically controlled resistors and the circuit integration can be seen.
Figure 2:
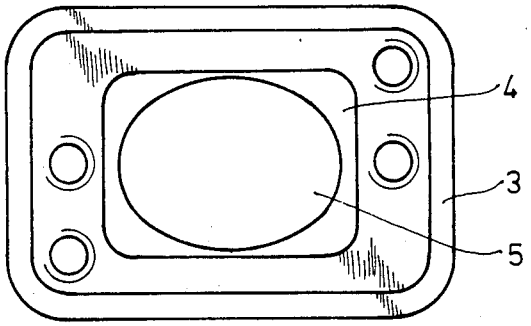
FIG. 2 shows a top view of a possible design of the surface area of the sensor, wherein the oval area may include the magnetically controlled magneto-resistors/resistances in any desired arrangement in the form of a surface matrix.
Figure 3:
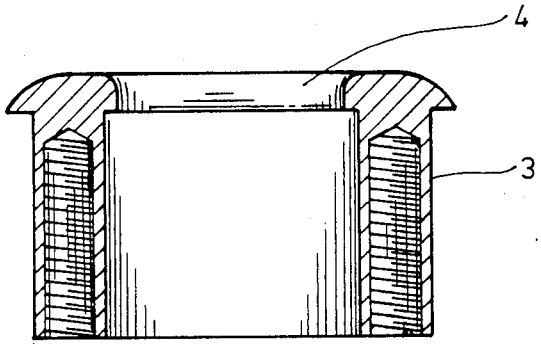
FIG. 3 shows a cross-section through the sensor of FIG. 2 illustrating that a matching recess is provided in the sensor for receiving the pick-up surface matrix of a possibly projecting pick-up area in guided relationship.

It should be noted at the outset that the embodiment shown in the drawing is only one preferred embodiment and meant to facilitate, and by no means to restrict the invention. In particular, the fact that in the described embodiment coding is effected in the sensor behind the area of the operational amplifiers and that decoding is effected using a diode matrix, does not restrict the subject-matter of the invention to this possibility. Rather, it goes without saying that coding may be effected also by the operational amplifiers, provided they are properly wired, in which case their rear outputs may feed a common resistor whose voltage is in this case emphasized to a specific level—a possibility that is mentioned here only by way of example.

There is a broad spectrum of applications for the safety mechanism of the invention including, for example, the use in locking systems for houses and buildings, remote-inquiry and freely codable locking systems, safety systems with remote code selection, safety systems for equipment and machines, in motor vehicle locks and the like, in alarm systems, bank safe-deposits, safes and the like, to mention only a few of the existing possibilities.

The invention comprises a pick-up which performs the function of a key, and a sensor which performs the corresponding function of a lock and which, when conformity between the codes in the pick-up and the sensor is determined, releases corresponding locking mechanisms or initiates certain switching operations serving to identify a person, give access to certain objects or to control the operation of alarm systems, or the like.

FIG. 1 shows a grossly enlarged representation of the surface area of the sensor 1 comprising a suitable housing 3 which may be of different designs, depending on the location and function of the system. The housing comprises a front contact surface of suitable design. A plurality of magnetically controlled sensor elements or resistors 6 are arranged there beneath and/or immediately adjacent thereto. The connection points of these resistors are connected in a suitable manner with external contact connections 8 and 8'. As has been mentioned earlier in this paper, this area of the sensor carrying the magnetically controllable resistors 6 and their wiring 7 may be set up in integrated circuit technology so that extremely small dimensions, combined with high precision as regards operation and construction, can be achieved in a suitable manner. The individual sensor elements, magnetically controllable resistors or magneto-resistors are in this case connected via the connection contacts 8, 8' with an evaluation circuit which will be explained in detail further below, in connection with the description of FIG. 5.

The illustrated embodiment further comprises a magnetic biasing element (not shown) provided adjacent resistors 6—as they will be called hereafter—and acting upon them in the desired manner. A biasing element may, for example, consist of an electromagnet or permanent magnet and may, in the inoperative condition of the system, associate to the individual resistors 6 a given magnetic field intensity in a manner such that they assume a specific resistance value resulting from the number of lines of magnetic force passing through or acting upon the magneto-resistors 6.

Further, the design of the safety system is such that magnetically active means are provided—or not provided—in the area of the pick-up in geometrical distribution identical to that of the magneto-resistors 6, i.e. preferably in the form of a surface matrix. When the active surface of the pick-up is applied to the sensitive receiver surface of the sensor, such magnetically active means cause the magnetic flux passing through specific magneto-resistors 6 to be varied (by their presence) or to remain unchanged—when no such element exists at the respective point. A preferred embodiment of the invention uses for the associated pick-up surface small or extremely small soft-iron elements at points where, according to the selected coding, the resistance value of the resistors 6 is to be varied, while at the remaining points elements or bodies may be provided which have no external magnetic effect, i.e. which are diamagnetic or paramagnetic. Such elements which influence selectively the magnetic field line distribution prevailing in the area of specific magneto-resistors 6 may take the form of soft-magnetic pins 9 whose end portions change the magnetic distribution prevailing in the sensor surface when the pick-up surface is brought into contact therewith.

Figure 4:
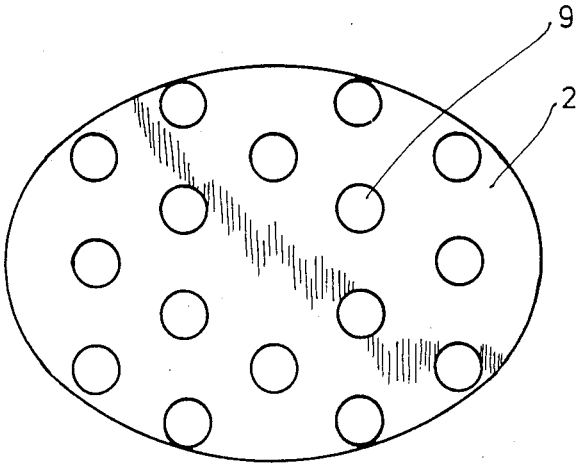
FIG. 4 is a diagrammatic enlarged representation of the oval portion of the pick-up area corresponding to the oval portion of the sensor, the small circles representing pick-up elements having a pre-determined magnetic permeability and provided in arbitrary distribution, which elements may take the form of pins and that influence the magnetic flux in the sensor area selectively.
Figure 5:
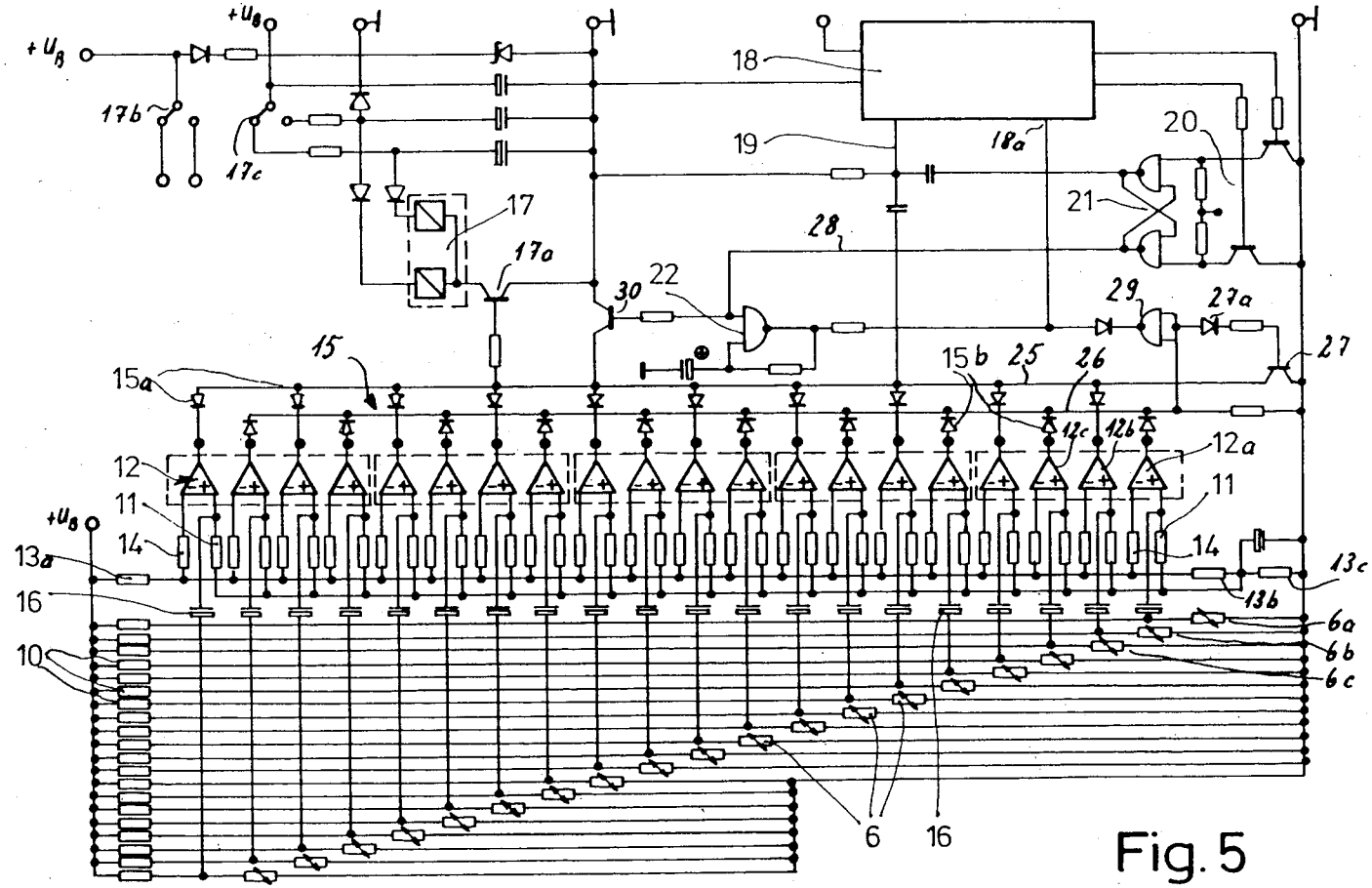
FIG. 5 is a view of a preferred embodiment of the electronic circuit area of the sensor showing also discrete circuit elements to the extent this is necessary for the proper understanding.

In the end, an evaluation circuit for the magneto-resistors 6 as shown in FIG. 5 is received for the sensor. It need not be stressed that the circuit made up of discrete circuit elements shown in FIG. 5 represents only one of the given possibilities of picking up and evaluating the relative variations in the condition of the magneto-resistors 6. This applies in particular to the manner in which the output signals of the operational amplifiers to which the magneto-resistors are connected are further processed. To facilitate the understanding, some polarities have been stated also in the circuit diagram of FIG. 4. It can be seen that each of the magneto-resistors 6 is connected via additional resistors 10 between positive supply voltage ($+U_B$) and ground. The beforementioned arrangement of a magnetic bias generator which subjects the resistors 6 to a preferably homogeneous magnetic field of given intensity leads to specific, preferably identical resistance values at the individual resistors 6 in the inoperative condition, although this is not really critical since they are d.c. decoupled relative to the comparators/operational amplifiers.

According to one essential inventive feature, for evaluating the selective resistance variation occurring when the pick-up and the sensor are brought into active contact, the individual resistors 6 have connected to their output ends operational amplifiers set up as comparators which have their two inputs biased through the same voltage divider. The latter comprises a series connection of three resistors 13*a*, 13*b*, and 13*c*, the middle resistor 13*b* being connected, by the voltage drop produced by it, to all inputs (negative inputs or inverting inputs and positive inputs or non-inverting inputs) of all comparators 12. In a preferred embodiment, this middle biasing resistor 13*b* has a relatively low ohmic resistance of, say, 10 ohms so that, depending of course on the supply voltages, a bias difference of 10 mV is produced by it in the present example, which is a little above the offset voltage of the operational amplifier. In this manner stable defined conditions of the operational amplifiers are achieved in the inoperative condition. Accordingly, this offset resistor 13*b* acts to ensure a stable initial condition, considering that the offset voltage remains always constant.

The respective magneto-resistors 6 are then connected by the connection points with their respective additional resistances via capacitors 16 to the non-inverting inputs of the operational amplifiers.

The outputs of the operational amplifiers are then connected for decoding to a diode matrix 15 comprising correspondingly polarized diodes 15*a* and 15*b* which are in turn connected to different, but common potential rails 25 and 26.

From this point onwards, i.e. from the outputs of the operational amplifiers, further decoding may also be effected by other means. One could, for instance, image that a microprocessor or calculator could be designed suitably to inquire in quick succession the values present at the outputs of the individual operational amplifiers, to compare them with a corresponding code word and to perform certain switching operations, release locking mechanism, or the like when conformity is established.

The following explanation of a particular evaluation circuit is, therefore, facultative and to be regarded merely as a preferred embodiment.

To facilitate the understanding, it would seem convenient to describe the comparator output rail 25 as a so-called H rail (derived from high=high potential) and to refer to the other potential rail 26 as the so-called L rail (derived from low=low potential, or connected to ground).

The wiring between these rails 25, 26 and the outputs of the operational amplifiers may of course vary extremely, depending on the code used. In the described example, the wiring has been arranged as shown for a single pre-determined code on the understanding that the sensor of the evaluation circuit is to regard the code as correct and identical only when during the time in which the resistors 6 are magnetically influenced by the pick-up elements 9, no negative signal or low signal is encountered on the H rails and, correspondingly, no high signal or positive signal is encountered on the L rail. Details of the functional sequences will be explained further below—the evaluation of the voltage conditions of the H rail 25 and the L rail 26 is effected by a switching transistor 17*a* directly feeding a bistable switching element 17 which then assumes corresponding switching conditions, releases locking mechanisms, or operates safety circuits. The other potential rail (L rail) serving to decode the diode matrix 15 is connected to a blocking transistor 27 which forms the base of the H rail against ground and which is thus capable of directly influencing the switching condition of the switching transistor 17*a*, and which further actuates, preferably via a counter 28, a safety circuit 20 in the form of a bistable element which, when a pre-determined number of unsuccessful attempts has been made, can also block the switching transistor 17*a* via a connection line 28, exciting at the same time and via the same line a time element 22, for example in the form of an oscillator, which must bring up the counter to a pre-determined number before a new attempt can be made.

The mode of operation is in this case as follows: The magneto-resistors 6 arranged preferably in the form of a surface matrix are biased by the permanent magnet not shown in the drawing. When a soft-iron part is introduced selectively into that area of the field lines where the magneto-resistors passing them are to be found, this will result in a concentration in the said area and a rise in resistance of the corresponding semi-conductor surface, due to the concentration of the field line density.

The key matrix of the pick-up comprises soft-iron pins 9 distributed in accordance with the selected code and congruent to the magneto-resistor matrix. Now, when the key is brought to coincide with the magneto-resistor matrix, the corresponding magneto-resistors are triggered, and a binary word is received whose number of bits corresponds to the number of resistors. The binary word is compared with a code word pre-set by suitable connection of the outputs of the comparators 12 to the diode matrix 15, and a switching operation is released when conformity is established. As has been mentioned before, the coding may be pre-set also by suitably wiring either the inverting or else the non-inverting inputs of the comparators 12, i.e. before the latter.

When the the pick-up surface is brought into contact with the sensor surface—an operation which should conveniently be aided by an external guide to ensure proper alignment—the circuit shown in FIG. 5 can scan the coding of the key/pick-up and compare it with its stored information.

The bistable switching element 17, which preferably takes the form of a stable mechanical relay comprising a first change-over contact 17*b* and a second change-over contact 17*c* ensures that the switching condition is stored mechanically, even in the case of a power failure.

When regarding the manner in which the diode matrix is wired in FIG. 5 with the comparator 12, it can be seen that if the switching transistor 17*a* is to be rendered conductive, the outputs of the operational amplifiers connected to the H rail 25 must not drop to low, because in this case the transistor 17*a* would block and the bistable relay 17 could not be triggered for a releasing operation. To say it in other words: A magneto-resistor must not trigger the comparator 12*a* connected to it by a rise in its resistance value and a positive voltage rise resulting therefrom in such a manner as to cause the operational amplifier to connect through and to apply a positive potential to the L rail 26, because this would influence the resistor 6*a* in manner not to conform with the "correct" coding. A positive potential on the rail 26 acts, via the diode 27*a*, to render conductive the blocking transistor 27 which connects the H rail 27 to ground potential, thus imparting to the base of the switching transistor 17*a* a negative bias preventing its through-connection. The same happens of course when one of the outputs of the comparators 12, which are connected directly to the H rail 25 via the associated diode, connects the said rail by itself to low, after having been triggered correspondingly by the associated resistor 6.

When such an error signal occurs for example on the L rail 26, the transistor 27 is connected through and, in addition, a counter input 18*a* of a counter 18 is activated through an inverter 29. After a pre-determined number of unsuccessful attempts (for example 7) the outputs of the counter 18 will then set a bistable element (flipflop 21) which, on the one hand, via connection line 28, drives an additional blocking transistor 30 which then practically bridges the base and emitter of the switching transistor 17*a* so as to secure its blocked condition, while on the other hand it excites the time element 22 (oscillator) which must supply to the counting input 18*a* of the counter 18 a pre-determined number of counting pulses before it can reset itself by a reset pulse supplied to its reset input 19, to release the sensor.

The bistable mechanical relay 17 arranged at the output end may have its two coils connected in such a manner that the two change-over contacts 17*b* and 17*c* are connected each with one position of one coil member and the other position of the other coil member, with a self-holding circuit being formed in both positions through the change-over contact 17*c*. The other change-over contact 17*b* can then be used to perform the desired switching operations for releasing or blocking a locking mechanism, releasing an alarm, or the like.

The selection of the, in this case, non-inverted inputs of the comparators 12 via capacitors 16 is essential for the present invention to prevent problems which might otherwise arise, in particular in the area of the magneto-resistor due to its important temperature variations, the high component tolerances, the general problems connected with aging, and the drift of all components. Due to its size and its time constant in connection with the involved resistors (approx. 1 second) the capacitor provides only a corresponding voltage jump for the switching operation, but decouples on the other hand the area of the comparators 12 efficiently from the area of the magneto-resistors so as to avoid the before-mentioned tolerance problems which basically culminate in that it would be practically impossible to pre-set the desired initial conditions and the stable inoperative positions of the comparator by means of mere voltage-divider circuits. In the present invention, it is also absolutely unproblematic how the pick-up is brought into active contact with the sensor—the long time constant ensures in any case that during insertion a circuit condition is obtained which can be evaluated for a releasing operation if the codes are found to be identical.

Apart from the fact that the sensor is blocked by the locking circuits in the area of the counter 18 and oscillator 22 when a pre-determined number of unsuccessful attempts has been made, the long time constant encountered in the input area and the delayed reaction of the bistable switching relay 17 resulting therefrom make it practically impossible to find the code by trying, for example with the aid of a binary code generator. Calculations have shown that taking into account the delayed reaction at the input, the fact that the sensor is blocked for a pre-determined period of time after a pre-set number of unsuccessful attempts, and the necessity, according to the statistical mean, to try at least 50% of all possible codes before the correct one will be found, the time required for finding the code by trying would be in the range of 24 years. And this on the basis of the only 20 magneto-resistors 6 of the present example, which give a possible number of different code word combinations of $2^{20-1}$.

All features mentioned in the specification and the following claims, and shown in the drawings may be essential to the invention either alone, or in any desired combination.

I claim:

1. In a device having a key pick-up means bearing a predetermined arrangement of one of magnetic and magnetically permeable material pick-up elements to form a code and extending in at least one dimension, lock sensor means with sensing elements having an ohmic resistance which is varied in response to the magnetic action of the pick-up elements, and an evaluation circuit connected to the output of said sensor means for comparing the code of the sensed pick-up means with a given sensor code to produce a releasing signal for a favorable comparison, the improvement wherein the sensor means comprises magnetically controllable resistors in a magnetically sensitive field plate distribution equal in number to and having the same geometrical extension and distribution as the pick-up elements and wherein the evaluation circuit has means for evaluating the correct code simultaneously upon applying every pick-up element onto its associated sensing element, whereby each sensing element only senses the magnetic action of one associated pick-up element and the evaluating means comprises a plurality of comparitors, and capacitors connected between said resistors and said comparitors to dynamically couple same, whereby only transient voltage jumps are applied to said comparaitors through said capacitors.

2. The device according to claim 1, wherein the distribution of said pick-up elements and the arrangement of the sensing elements is a two-dimensional surface matrix.

3. The device according to claim 1, wherein the sensor means comprises the controllable resistors in a magnetically sensitive field-plate distribution and a magnetic bias generator for generating a homogeneous distribution of magnetic field lines in the resistors for presetting a pre-determined resistance value of the resistors in their unvaried condition.

4. The device according to claim 1, wherein one comparator is associated with each resistor, and a common voltage divider is connected to inputs of each comparator to bias said comparators to a stable, defined initial condition.

5. The device according to claim 4, wherein each comparator comprises an operational amplifier having two inputs, the common voltage divider for all of the comparators comprises a series connection of a first resistor, a middle offset resistor and a base resistor, with two connection points of the offset resistor to each of the two inputs of each operational amplifier.

6. The device according to claim 4, wherein the evaluating means comprises a diode matrix corresponding to the given sensor code and wherein the outputs of the comparators are connected to said diode matrix for comparing the sensed code to the given code.

7. The device according to claim 4, wherein the given code word of the sensor means is determined internally by corresponding selective connection of the outputs of said resistors to the respective inputs of the comparators.

8. The device according to claim 6, further comprising two potential rails connected to the outputs of the diode matrix, a logic element controlled by one of said potential rails and a bistable output element operable by said logic element when there is a favorable comparison.

9. The device according to claim 8, wherein the said potential rails each carry a potential which blocks said logic element when there is an unfavorable comparison.

10. The device according to claim 8, further comprising a safety circuit for protecting against multiple unfavorable comparisons which comprises a counter which is excited every time an unfavorable comparison is made, and blocking means connected to said counter and said logic element and rendering said logic element inoperative in response to a given count.

11. The device according to claim 2, wherein the surface matrix of said pick-up means is part of a ring worn by a user.

* * * * *